US011091826B2

(12) United States Patent
Martin et al.

(10) Patent No.: US 11,091,826 B2
(45) **Date of Patent: *Aug. 17, 2021**

(54) HYDRIDE-COATED MICROPARTICLES AND METHODS FOR MAKING THE SAME

(71) Applicant: HRL Laboratories, LLC, Malibu, CA (US)

(72) Inventors: John H. Martin, Oxnard, CA (US); Tobias A. Schaedler, Oak Park, CA (US); Adam F. Gross, Santa Monica, CA (US); Alan J. Jacobsen, Woodland Hills, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/994,595

(22) Filed: Aug. 16, 2020

(65) Prior Publication Data

US 2020/0377983 A1 Dec. 3, 2020

Related U.S. Application Data

(62) Division of application No. 14/720,757, filed on May 23, 2015, now Pat. No. 10,030,292.

(Continued)

(51) Int. Cl.
*C22C 49/00* (2006.01)
*B22F 1/00* (2006.01)

(Continued)

(52) U.S. Cl.
CPC ..... *C22C 49/00* (2013.01); *B22F 1/0011* (2013.01); *B22F 1/02* (2013.01); *B22F 3/1039* (2013.01);

(Continued)

(58) Field of Classification Search
CPC ..... C22C 49/00; C22C 1/0416; B22F 1/02; B22F 1/0011; B22F 3/1039; B22F 1/0018;

(Continued)

(56) References Cited

U.S. PATENT DOCUMENTS 5,305,726 A 4/1994 Scharman et al.
5,340,012 A 8/1994 Beeferman et al.

(Continued)

FOREIGN PATENT DOCUMENTS

JP 2011054892 A 3/2011
KR 1020080105250 A 12/2008
WO 2005017220 A1 2/2005

OTHER PUBLICATIONS

Chen et al., "Rapid control of phase growth by nanoparticles," Nature Communications 5:3879 DOI: 10.1038/ncomms4879.

(Continued)

*Primary Examiner* — Anthony J Zimmer
(74) *Attorney, Agent, or Firm* — O'Connor & Company

(57) ABSTRACT

A metal microparticle coated with metal hydride nanoparticles is disclosed. Some variations provide a material comprising a plurality of microparticles (1 micron to 1 millimeter) containing a metal or metal alloy and coated with a plurality of nanoparticles (less than 1 micron) containing a metal hydride or metal alloy hydride. The invention eliminates non-uniform distribution of sintering aids by attaching them directly to the surface of the microparticles. No method is previously known to exist which can assemble nanoparticle metal hydrides onto the surface of a metal microparticle. Some variations provide a solid article comprising a material with a metal or metal alloy microparticles coated with metal hydride or metal alloy hydride nanoparticles, (Continued)

wherein the nanoparticles form continuous or periodic inclusions at or near grain boundaries within the microparticles.

11 Claims, 9 Drawing Sheets

Related U.S. Application Data

(60) Provisional application No. 62/002,916, filed on May 26, 2014.

(51) Int. Cl.
*B22F 1/02* (2006.01)
*B22F 3/10* (2006.01)
*C22C 1/04* (2006.01)

(52) U.S. Cl.
CPC ..... *B22F 1/0018* (2013.01); *B22F 1/0062* (2013.01); *B22F 2001/0029* (2013.01); *B22F 2999/00* (2013.01); *C22C 1/0416* (2013.01)

(58) Field of Classification Search
CPC ..... B22F 2999/00; B22F 1/0062; B22F 2001/0029
See application file for complete search history.

(56) References Cited

U.S. PATENT DOCUMENTS

| | | | |
|---|---|---|---|
| 5,462,712 | A | 10/1995 | Langan et al. |
| 6,024,915 | A | 2/2000 | Kume et al. |
| 6,071,628 | A | 6/2000 | Seals et al. |
| 6,254,757 | B1 | 7/2001 | Lashmore et al. |
| 6,368,427 | B1 | 4/2002 | Sigworth |
| 9,238,877 | B2 | 1/2016 | Krause et al. |
| 2002/0136884 | A1 | 9/2002 | Oechsner |
| 2003/0077473 | A1 | 4/2003 | Bretschneider et al. |
| 2003/0104147 | A1 | 6/2003 | Bretschneider et al. |
| 2005/0238528 | A1 | 10/2005 | Lin et al. |
| 2006/0065330 | A1 | 3/2006 | Cooper et al. |
| 2010/0288243 | A1 | 11/2010 | Kaburagi et al. |
| 2012/0135142 | A1 | 5/2012 | Yang et al. |
| 2012/0315399 | A1 | 12/2012 | Feng et al. |
| 2013/0012643 | A1 | 1/2013 | Monsheimer et al. |
| 2013/0146041 | A1 | 6/2013 | Hijii et al. |
| 2013/0152739 | A1 | 6/2013 | Li et al. |
| 2015/0252451 | A1 | 9/2015 | Al-Aqeeli et al. |
| 2015/0337423 | A1 | 11/2015 | Martin et al. |
| 2017/0016095 | A1 | 1/2017 | Karlen et al. |
| 2017/0252851 | A1 | 9/2017 | Fulop et al. |

OTHER PUBLICATIONS

Sheppard et al., "The Mechanochemical synthesis of magnesium hydride nanoparticles" Journal of Alloys and Compounds 492 (2010) L72-L74.

Zhu et al., "Growth Mechanism for the Controlled Synthesis of MgH2/Mg Crystals via a Vapor-Solid Process" Cryst. Growth Des. 2011, 11, 4166-4174.

Högberg et al., "Reactive sputtering of δ-ZrH2 thin films by high power impulse magnetron sputtering and direct current magnetron sputtering," Journal of Vacuum Science & Technology A 2014, 32, 041510.

Gharatloo et al., "Ultrasound-assisted synthesis of nano-structured zirconium hydride at room temperature," International Journal of Hydrogen Energy 40 (2015) 13942-13948.

Mukherjee et al., "Printability of alloys for additive manufacturing" Scientific Reports | 6:19717 | DOI: 10.1038/srep19717, Jan. 22, 2016.

He et al., "Alloying element vaporization during laser spot welding of stainless steel" J. Phys. D: Appl. Phys. 36 (2003) 3079-3088.

Bartkowiak et al., "New Developments of Laser Processing Aluminium Alloys via Additive Manufacturing Technique" Physics Procedia 12 (2011) 393-401.

Zhang et al., "Grain Refinement and Mechanical Properties of Cu—Cr—Zr Alloys with Different Nano-Sized TiCp Addition" Materials 2017, 10, 919; doi:10.3390/ma10080919.

Roberts et al., "A novel processing approach for additive manufacturing of commercial aluminum alloys" Physics Procedia 83 ( 2016 ) 909-917.

Martin et al., "3D printing of high-strength aluminium alloys" Nature, vol. 549, Sep. 21, 2017.

HYDRIDE-COATED MICROPARTICLES AND METHODS FOR MAKING THE SAME

PRIORITY DATA

This patent application is a divisional application of U.S. patent application Ser. No. 16/014,014, filed on Jun. 21, 2018 (now allowed) which is a divisional application of U.S. Pat. No. 10,030,292, issued on Jul. 24, 2018, which claims priority to U.S. Provisional Patent App. No. 62/002,916, filed on May 26, 2014, each of which is hereby incorporated by reference herein.

FIELD OF THE INVENTION

The present invention generally relates to microparticles and objects containing such microparticles.

BACKGROUND OF THE INVENTION

The ability to sinter certain materials at a low temperature is extremely important. Certain high-strength alloys of aluminum cannot be processed using conventional powder metallurgy techniques. This is due to a high sintering temperature which results in eutectic melting and/or peritectic decomposition of the alloy, forming a non-ideal two-phase structure. Furthermore, the self-passivating nature of aluminum and other alloys leads to oxides scales on powders if exposed to air, thus inhibiting sintering. Conventional powder processing techniques rely on mechanical force, e.g. pressing or extruding, to break up the oxide scale and enable consolidation.

Hydride micropowders are sometimes used in powder metallurgy applications as sintering aids, reducing agents, and/or foaming agents. These powders are mixed or milled together, often resulting in a non-uniform distribution of powders. Improvements are desired to eliminate non-uniform distribution of sintering aids.

SUMMARY OF THE INVENTION

The present invention addresses the aforementioned needs in the art, as will now be summarized and then further described in detail below.

Some variations provide a material comprising a plurality of metal-containing or metal alloy-containing microparticles that are at least partially coated with a plurality of nanoparticles containing a metal hydride or metal alloy hydride, wherein the microparticles are characterized by an average microparticle size between about 1 micron to about 1 millimeter, and wherein the nanoparticles are characterized by an average nanoparticle size less than 1 micron. In preferred embodiments, the material is in powder form.

The microparticles may be solid, hollow, or a combination thereof. In some embodiments, the average microparticle size is between about 10 microns to about 500 microns. The microparticles may be characterized by an average microparticle aspect ratio from about 1:1 to about 100:1, for example.

The average nanoparticle size may be between about 10 nanometers to about 500 nanometers, for example. The nanoparticles may be characterized by an average nanoparticle aspect ratio from about 1:1 to about 100:1, for example.

In some embodiments, the plurality of nanoparticles forms a nanoparticle coating that is between about 5 nanometers to about 100 microns thick. The nanoparticle coating may contain a single layer or may contain multiple layers of the nanoparticles. In certain embodiments, the nanoparticle coating is continuous on the microparticles. In other embodiments, the nanoparticle coating is discontinuous on the microparticles.

Many compositions are possible. The microparticles may contain one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof. In certain embodiments, the microparticles contain aluminum or an aluminum alloy. The microparticles typically do not contain any metals or metal alloys that are contained (in hydride form) in the nanoparticles.

The nanoparticles contain hydrogen and may contain one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof. In certain embodiments, the nanoparticles contain titanium hydride, zirconium hydride, magnesium hydride, hafnium hydride, combinations thereof, or alloys of any of the foregoing.

In some embodiments, the nanoparticles are attached to the microparticles with organic ligands. Such organic ligands may be selected from the group consisting of aldehydes, alkanes, alkenes, carboxylic acid, alkyl phosphates, alkyl amines, silicones, polyols, and combinations or derivatives thereof. In some embodiments, the organic ligands are selected from the group consisting of poly(acrylic acid), poly(quaternary ammonium salts), poly(alkyl amines), poly (alkyl carboxylic acids) including copolymers of maleic anhydride or itaconic acid, poly(ethylene imine), poly(propylene imine), poly(vinylimidazoline), poly(trialkylvinyl benzyl ammonium salt), poly(carboxymethylcellulose), poly(D- or L-lysine), poly(L-glutamic acid), poly(L-aspartic acid), poly(glutamic acid), heparin, dextran sulfate, 1-carrageenan, pentosan polysulfate, mannan sulfate, chondroitin sulfate, and combinations or derivatives thereof.

In other embodiments, the nanoparticles are attached to the microparticles without organic ligands.

Other variations of the invention provide a material (e.g., powder) comprising a plurality of non-metallic microparticles that are at least partially coated with a plurality of nanoparticles containing a metal hydride or metal alloy hydride, wherein the microparticles are characterized by an average microparticle size from between 1 micron to about 1 millimeter, and wherein the nanoparticles are characterized by an average nanoparticle size less than 1 micron.

In some embodiments, the average microparticle size is between about 10 microns to about 500 microns and/or the average nanoparticle size is between about 10 nanometers to about 500 nanometers.

The plurality of nanoparticles may form a single-layer or multiple-layer nanoparticle coating (on microparticles) that is between about 5 nanometers to about 100 microns thick, for example.

The non-metallic microparticles may contain one or more materials selected from the group consisting of a glass, a ceramic, an organic structure, a composite, and a combination thereof.

The nanoparticles contain hydrogen and may contain one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof.

In some embodiments, the nanoparticles are attached to the microparticles with organic ligands, such as organic ligands selected from the group consisting of aldehydes, alkanes, alkenes, silicones, polyols, poly(acrylic acid), poly (quaternary ammonium salts), poly(alkyl amines), poly(alkyl carboxylic acids) including copolymers of maleic anhydride or itaconic acid, poly(ethylene imine), poly(propylene imine), poly(vinylimidazoline), poly(trialkylvinyl benzyl ammonium salt), poly(carboxymethylcellulose), poly(D- or L-lysine), poly(L-glutamic acid), poly(L-aspartic acid), poly (glutamic acid), heparin, dextran sulfate, 1-carrageenan, pentosan polysulfate, mannan sulfate, chondroitin sulfate, and combinations or derivatives thereof.

In other embodiments, the nanoparticles are attached to the microparticles without organic ligands. Also it is possible that a portion of the nanoparticles is attached to the microparticles with organic ligands and the remainder of the nanoparticles is attached to the microparticles without organic ligands.

Some variations provide a solid article comprising at least 0.25 wt % of a material containing a plurality of metal-containing or metal alloy-containing microparticles that are at least partially coated with a plurality of metal hydride or metal alloy hydride nanoparticles, wherein the nanoparticles form continuous or periodic inclusions at or near grain boundaries between the microparticles.

The microparticles may be characterized by an average microparticle size between about 1 micron to about 1 millimeter. The nanoparticles may be characterized by an average nanoparticle size less than 1 micron.

The solid article may contain at least about 1 wt %, 5 wt %, 10 wt %, 20 wt %, 30 wt %, 40 wt %, 50 wt %, 60 wt %, 70 wt %, 80 wt %, 90 wt %, 95 wt %, or more, of the material.

In some solid articles, the plurality of nanoparticles forms a nanoparticle coating (in one or multiple layers) that is between about 5 nanometers to about 100 microns thick.

In some embodiments, the microparticles contain one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof.

In some embodiments, the nanoparticles contain hydrogen and one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof.

In these solid articles, the nanoparticles may be attached to the microparticles with organic ligands such as organic ligands selected from the group consisting of aldehydes, alkanes, alkenes, silicones, polyols, poly(acrylic acid), poly (quaternary ammonium salts), poly(alkyl amines), poly(alkyl carboxylic acids) including copolymers of maleic anhydride or itaconic acid, poly(ethylene imine), poly(propylene imine), poly(vinylimidazoline), poly(trialkylvinyl benzyl ammonium salt), poly(carboxymethylcellulose), poly(D- or L-lysine), poly(L-glutamic acid), poly(L-aspartic acid), poly (glutamic acid), heparin, dextran sulfate, 1-carrageenan, pentosan polysulfate, mannan sulfate, chondroitin sulfate, and combinations or derivatives thereof.

The solid article may be produced by a process selected from the group consisting of hot pressing, cold pressing and sintering, extrusion, injection molding, additive manufacturing, electron beam melting, selected laser sintering, pressureless sintering, and combinations thereof.

In some embodiments, the article is a sintered structure with a porosity between 0% and about 75%.

The solid article may be, for example, a coating, a coating precursor, a substrate, a billet, a net shape part, a near net shape part, or another object.

DETAILED DESCRIPTION OF EMBODIMENTS OF THE INVENTION

Figure 1:
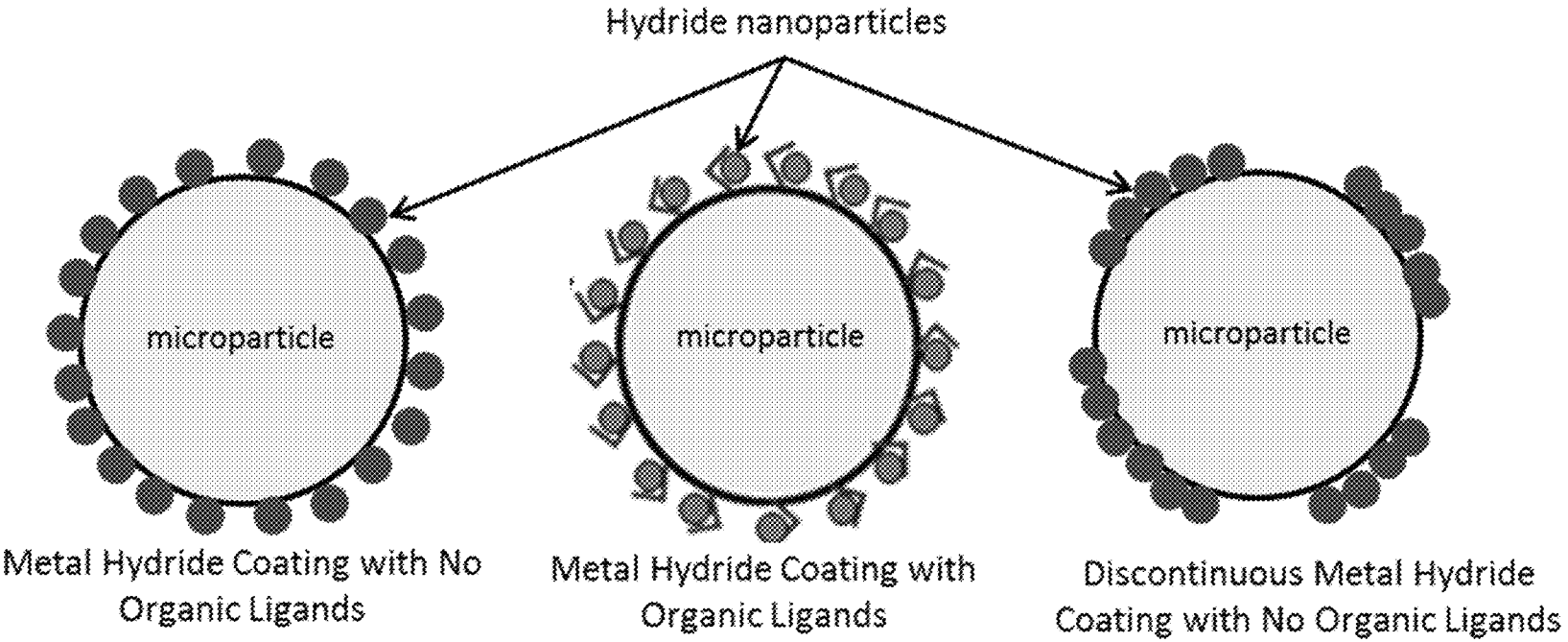
FIG. 1 is an illustration of three possible nano-metal hydride coatings on a microparticle, in several embodiments.

The structures, compositions, and methods of the present invention will be described in detail by reference to various non-limiting embodiments.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Variations of the invention are premised on metal hydride-coated microparticles. A microparticle of various compositions may be coated with nanoparticles of a metal hydride, with or without an organic binder. The disclosed method establishes a procedure for assembly of metal hydride nanoparticles onto a microparticle substrate in which the hydride attachment to the surface results from an attractive force between the microparticles and nanoparticles (i.e., it is not mechanical in nature).

Some variations provide a material comprising a plurality of metal-containing or metal alloy-containing microparticles that are at least partially coated with a plurality of nanoparticles containing a metal hydride or metal alloy hydride, wherein the microparticles are characterized by an average microparticle size between about 1 micron to about 1 millimeter, and wherein the nanoparticles are characterized by an average nanoparticle size less than 1 micron. In preferred embodiments, the material is in powder form.

In preferred embodiments, the material is in powder form. As used herein, a "powder" or "micropowder" is a state of fine, loose particles. This invention is capable of altering the surface activity of micropowders, thereby enabling lower-temperature sintering of micropowders.

In particular, variations of this invention eliminate non-uniform distribution of sintering aids by attaching them directly to the surface of the microparticles. No prior method is known to exist which is capable of assembling nanoparticle metal hydrides onto the surface of a metal microparticle.

Microparticles with nano-hydride coatings may be thermally activated to remove hydrogen from the nanoparticles, enabling surface reactions that enhance sintering of the microparticles. Nano-hydride coatings can encourage oxide displacement on the surface of aluminum alloy powders, for example, allowing sintering at temperatures below the eutectic melting point or peritectic decomposition temperature. In addition to such oxide displacement, hydride nanoparticles may form eutectics at the microparticle surfaces, thereby inducing liquid-phase sintering throughout the powder bed.

Sintering aluminum powders is very difficult due to the tough oxide shell. Using nano-hydride coatings on the surface of aluminum powder enables a surface breakdown of the oxide, allowing sintering at a lower processing temperature. Use of hydrides is important because of their relative air stability versus pure metal nanoparticles. For instance, zirconium nanoparticles are pyrophoric in air or undergo immediate oxidation rendering them inactive for the desired application, while zirconium hydride nanoparticles can be handled in air without issue.

The present invention is by no means limited to aluminum alloys. The principles and features set forth herein are applicable to other alloys which may have similar sintering issues.

As used herein, "metal microparticle" means a metal-containing particle or distribution of particles with an average diameter of less than 1 cm (typically less than 1 mm). The shape of these particles can vary greatly from spherical to aspect ratios of 100:1. The metal may be any metal or metal alloy which is solid above 50° C. The metal or metal alloy is preferably a different composition than the metal hydride nanoparticle that coats it. The metal or metal alloy may or may not have an oxide shell on the surface. Particles may be solid, hollow, or closed-cell foams. Some possible metal microparticles include, but are not limited to, aluminum, titanium, tungsten, or alloys of these metals.

As used herein, "non-metal microparticle" means a non-metal-containing particle or distribution of particles with an average diameter of less than 1 cm (typically less than 1 mm). The shape of these particles can vary greatly from spherical to aspect ratios of 100:1. The microparticle "aspect ratio" is defined as the ratio of the longest dimension to the shortest dimension in the microparticle.

Particles may be solid, hollow, or closed cell foams. These particles may be glass, ceramic, organic, or a composite material, for example. When not specified, a microparticle may be either a metal microparticle or a non-metal microparticle, or a combination thereof. Microparticles can be made through any means including but not limited to gas atomization, water atomization, and milling.

As used herein, "metal hydride nanoparticle" (or "nano-metal hydride") means a particle or distribution of particles with an average diameter of less than 1 micron. The shape of these nanoparticles can vary greatly from spherical to aspect ratios of 100:1. The nanoparticle "aspect ratio" is defined as the ratio of the longest dimension to the shortest dimension in the nanoparticle.

The hydrides may be (or contain) a pure metal hydride or a metal alloy hydride. When coating metal microparticles, the composition of the metals should be different.

Nanoparticles can be made by any means including, for example, milling, cryomilling, wire explosion, laser ablation, electrical-discharge machining, or other techniques known in the art.

Some metal hydride nanoparticles may include, but are not limited to, titanium hydride, zirconium hydride, magnesium hydride, hafnium hydride, or alloys of these metals at various stoichiometric ratios of total hydrogen.

In some embodiments, the invention provides a microparticle coated with nanoparticles of a metal hydride. The metal hydride nanoparticles may include a metal or metal alloy hydride with a particle size less than 1 micron. Microparticles to be coated can be a different metal or alloy from the metal hydride, or another material such as a ceramic, glass, polymer, or composite material.

Microparticles may be solid, hollow, or closed cell in any shape. Microparticles are generally considered to be less than 1 mm in diameter. However, in some embodiments, a nano-hydride coating may be applied to larger particles or structures, including particles up to 1 cm in diameter, or even larger.

The metal hydride nanoparticle coating may be 1 to 5 layers thick and is not necessarily continuous across the surface. Nanoparticles may attach to the surface using Van der Waals or electrostatic attraction between the nanoparticles and microparticles. In some cases, when the Van der Waals forces are strong enough, the coating may be applied without the use of solvents. For example, a gas mixing apparatus may be utilized, provided the gas does not react with the particles. The attraction may be improved by using organic ligands.

A graphical representation is shown in FIG. 1, which depicts three possible nano-metal hydride coatings on a microparticle.

In some embodiments, the metal hydride nanoparticle coating consists of one composition of metal hydride on one composition of microparticle. In other embodiments, multiple metal hydride compositions may be used to create the coating either through layering or simultaneous depositions. This may improve the desired reactions. Likewise, the coated microparticles may be of different compositions or materials. This may be used to create a mixed final product with variable powder properties through the product. It is also possible to combine multiple compositions of microparticles with layers of multiple compositions of metal hydride nanoparticles. These may be produced simultaneously or through a stepwise fashion with a final mixing of structures at the end of processing, for example.

Some embodiments provide a method for attaching nanoparticle hydrides to a microparticle substrate. In some embodiments, nanoparticle hydrides are dissolved or suspended in a solvent and then microparticles are added to the suspension for a period of time to coat the microparticles with nanoparticles.

Figure 2:
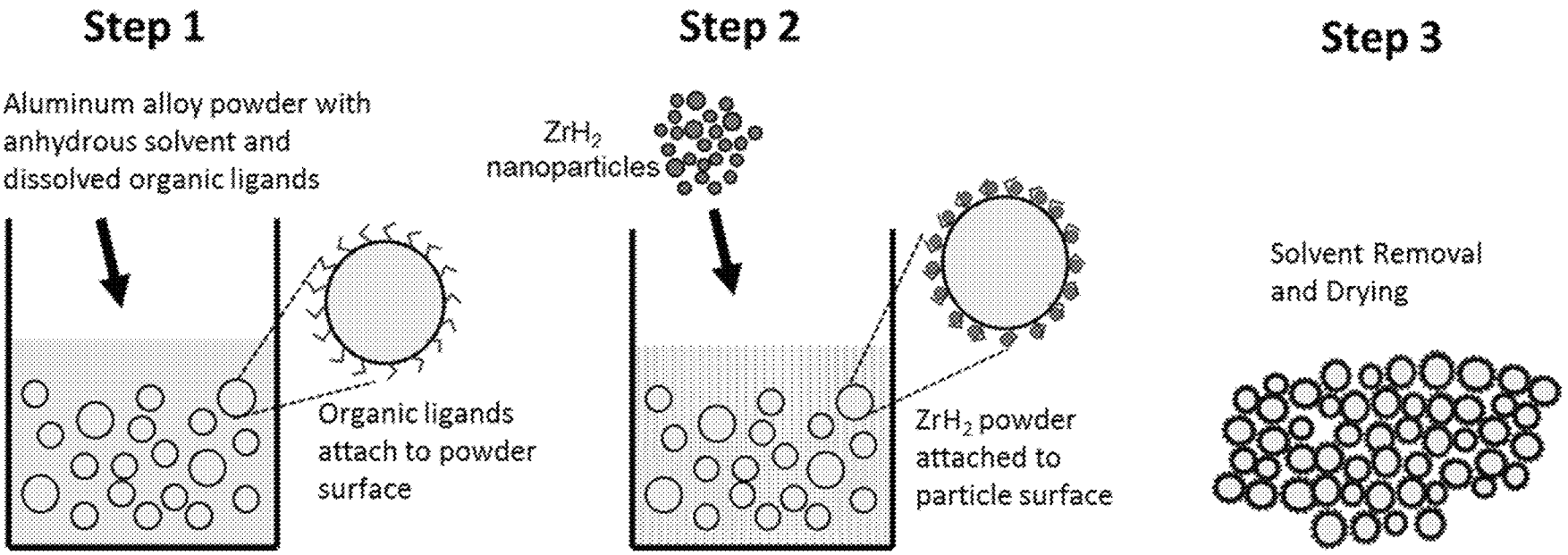
FIG. 2 is a schematic of an exemplary processing route for nano-metal hydride assembly onto a microparticle.

Particle attraction may be affected by the addition of salts, organic molecules, or acids and bases. The organic ligands may contain amine, carboxylic acid, thiol, or cyano functional groups, for example. These ligands may be added at any time during the process or to an individual component prior to final assembly. For instance, the microparticles may be mixed in a solvent with organic ligands to coat the microparticle surface with active charge sites prior to mixing with the metal hydride nanoparticles. Likewise, salts may be added with the metal hydride nanoparticles prior to the addition of the microparticles. A schematic of an exemplary processing route for nano-metal hydride assembly onto a microparticle is shown in FIG. 2.

A solvent is any liquid which can be used without substantial oxidation or reaction with the microparticle or metal hydride nanoparticle. The microparticles or metal hydride nanoparticles should not be soluble in the solvent used. Preferably, the solvent does not change particle size, surface composition, particle composition, and/or reactivity of the particles. In preferred embodiments, the solvent is anhydrous, such as tetrahydrofuran (THF). In certain embodiments, water or a solvent with substantial water content may be applicable due to the stability of the particles. In some embodiments, a suspension is formed, i.e. a mixture of particles in solution which may eventually settle out after active mixing is stopped.

Solvents or solvent suspensions which contain organic ligands or other reactive species described above, which react with microparticles or nanoparticles, may be desirable to functionalize one or both of the particles prior to removal of the solvent and nanoparticle assembly. In some embodiments, functionalization alters the surface charge of the microparticle or nanoparticle. This may involve salt additions or attachment of organic ligands. Functionalization may be used to increase or decrease the attractive force between microparticles and nanoparticles to help control coating thickness and degree of coverage, for example.

Some embodiments employ organic ligands to assist in nanoparticle bonding to the microparticles. An organic ligand refers to any organic molecule or polymer which can be attached to the microparticle or nanoparticle to influence coating or assembly. The organic ligands may contain amine, carboxylic acid, thiol, or cyano functional groups. In some embodiments, these organic ligands may contain or be silanes. Some possible organic ligands include but are not limited to poly acrylic acid), poly (quaternary ammonium salts), poly (alkyl amines), poly (alkyl carboxylic acids) including copolymers of maleic anhydride or itaconic acid, poly(ethylene imine), poly(propylene imine), poly(vinylimidazoline), poly(trialkylvinyl benzyl ammonium salt), heparin, dextran sulfate, 1-carrageenan, pentosan polysulfate, mannan sulfate, chondroitin sulfate, poly(carboxymethylcellulose), poly(D- or L-Lysine), poly(L-glutamic acid), poly(L-aspartic acid), or poly(glutamic acid). Other organic ligands may include glycerol and aldehydes.

"Assembly" may refer to the act of nanoparticles coating the surface of a microparticle driven by an attractive force between the particles. A "coating" refers to metal hydride nanoparticles attached or connected to the surface of a microparticle. This coating may be continuous or discontinuous (see FIG. 1) and is characterized by greater than 0.25%, 1%, 5%, 10%, 25%, 50%, 75%, or 95% (or more, including 100%) surface area coverage of metal hydride nanoparticles on a microparticle. The coating includes one and/or all subsequent layers of metal hydride nanoparticles. A "layer" is defined as one coating step and may be between 5 nm and 100 microns thick in the coated areas. Multiple layers may exist.

The microparticles may be solid, hollow, or a combination thereof. In some embodiments, the average microparticle size is between about 10 microns to about 500 microns. The microparticles may be characterized by an average microparticle aspect ratio from about 1:1 to about 100:1, for example.

The average nanoparticle size may be between about 10 nanometers to about 500 nanometers, for example. The nanoparticles may be characterized by an average nanoparticle aspect ratio from about 1:1 to about 100:1, for example.

In some embodiments, the nanoparticles are in the shape of nanorods. By "nanorod" is meant a rod-shaped particle or domain with a diameter of less than 100 nanometers. Nanorods are nanostructures shaped like long sticks or dowels with a diameter in the nanoscale but a length that is longer or possibly much longer (like needles). Nanorods may also be referred to as nanopillars, nanorod arrays, or nanopillar arrays.

The average diameter of the nanorods may be selected from about 0.5 nanometers to about 100 nanometers, such as from about 1 nanometer to about 60 nanometers. In some embodiments, the nanorods have an average diameter of about 60 nanometers or less. The average axis length of the nanorods may be selected from about 1 nanometer to about 1000 nanometers, such as from about 5 nanometers to about 500 nanometers. When the aspect ratio is large, the length may be in the micron scale.

The nanorod length-to-width ratio is equal to the aspect ratio, which is the axial length divided by the diameter. Nanorods need not be perfect cylinders, i.e. the axis is not necessarily straight and the diameter is not necessarily a perfect circle. In the case of geometrically imperfect cylinders (i.e. not exactly a straight axis or a round diameter), the aspect ratio is the actual axial length, along its line of curvature, divided by the effective diameter, which is the diameter of a circle having the same area as the average cross-sectional area of the actual nanorod shape.

The nanoparticles may be anisotropic. As meant herein, "anisotropic" nanoparticles have at least one chemical or physical property that is directionally dependent. When measured along different axes, an anisotropic nanoparticle will have some variation in a measurable property. The property may be physical (e.g., geometrical) or chemical in nature, or both. The property that varies along multiple axes may simply be the presence of mass; for example, a perfect sphere would be geometrically isotropic while a cylinder is geometrically anisotropic. A chemically anisotropic nanoparticle may vary in composition from the surface to the bulk phase, such as via a chemically modified surface or a coating deposited on the nanoparticle surface. The amount of variation of a chemical or physical property may be 5%, 10%, 20%, 30%, 40%, 50%, 75%, 100% or more.

In some embodiments, the plurality of nanoparticles forms a nanoparticle coating that is between about 5 nanometers to about 100 microns thick. The nanoparticle coating may contain a single layer or may contain multiple layers of the nanoparticles. In certain embodiments, the nanoparticle coating is continuous on the microparticles. In other embodiments, the nanoparticle coating is discontinuous on the microparticles.

Many compositions are possible. The microparticles may contain one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof. In certain embodiments, the microparticles contain aluminum or an aluminum alloy. The microparticles typically do not contain any metals or metal alloys that are contained (in hydride form) in the nanoparticles.

The nanoparticles contain hydrogen and may contain one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof. In certain embodiments, the nanoparticles contain titanium hydride, zirconium hydride, magnesium hydride, hafnium hydride, combinations thereof, or alloys of any of the foregoing.

The metal or metals present in the nanoparticles (as metal hydrides) may be the same or different than the metal or metals present in the microparticles. In certain embodiments, the nanoparticles contain the same metal—primarily in hydride form—that makes up the microparticles. That is, a metal M may be employed in the microparticles and the corresponding metal hydride $MH_x$ may be employed in the nanoparticles.

However, the hydride nanoparticle coating on the microparticles is not simply a hydride form of the metal in the microparticle. That is, even when the selected metals are the same, the metal (or metal alloy) hydride nanoparticles are structurally distinct from the metal (or metal alloy) microparticle phase, recognizing that in this situation some amount of the phenomenon of contact welding may occur between nanoparticles and microparticles.

In some embodiments, the nanoparticles contain no greater than 50, 40, 30, 20, or 10 atomic percent (at %) of the metal or metals that make up the microparticles. In some embodiments, the microparticles contain no greater than 50, 40, 30, 20, or 10 atomic percent (at %) of the metal or metals that make up the nanoparticles.

It should also be noted that the nanoparticles contain a metal hydride or metal alloy hydride, but may further contain non-hydride metals or metal alloys, or non-metal additives. In various embodiments, the extent of hydridization (fraction of metal hydride divided by total metal present) of the nanoparticles is between about 0.1 to about 1, such as about 0.5, 0.6, 0.7, 0.8, 0.9, 0.95, 0.99, or 1.0 (1.0 being the case of complete hydridization of all metal species in the nanoparticles).

The amount of material in the nanoparticles, compared to the amount of material in the microparticles, may vary widely, depending on the particle sizes of nanoparticles and microparticles, the desired thickness of nanoparticle coating, and the desired surface coverage of nanoparticles (i.e. continuous or discontinuous). In various embodiments, the weight ratio of total metals contained in the nanoparticles divided by total metals contained in the microparticles is between about 0.001 to about 1, such as about 0.005, 0.01, 0.05, or 0.1, for example.

In some embodiments, the nanoparticles are attached to the microparticles with organic ligands. Such organic ligands may be selected from the group consisting of aldehydes, alkanes, alkenes, carboxylic acid, alkyl phosphates, alkyl amines, silicones, polyols, and combinations or derivatives thereof. In some embodiments, the organic ligands are selected from the group consisting of poly(acrylic acid), poly(quaternary ammonium salts), poly(alkyl amines), poly (alkyl carboxylic acids) including copolymers of maleic anhydride or itaconic acid, poly(ethylene imine), poly(propylene imine), poly(vinylimidazoline), poly(trialkylvinyl benzyl ammonium salt), poly(carboxymethylcellulose), poly(D- or L-lysine), poly(L-glutamic acid), poly(L-aspartic acid), poly(glutamic acid), heparin, dextran sulfate, 1-carrageenan, pentosan polysulfate, mannan sulfate, chondroitin sulfate, and combinations or derivatives thereof.

In other embodiments, the nanoparticles are attached to the microparticles without organic ligands.

Other variations of the invention provide a material (e.g., powder) comprising a plurality of non-metallic microparticles that are at least partially coated with a plurality of nanoparticles containing a metal hydride or metal alloy hydride, wherein the microparticles are characterized by an average microparticle size from between 1 micron to about 1 millimeter, and wherein the nanoparticles are characterized by an average nanoparticle size less than 1 micron.

In some embodiments, the average microparticle size is between about 10 microns to about 500 microns and/or the average nanoparticle size is between about 10 nanometers to about 500 nanometers.

The plurality of nanoparticles may form a single-layer or multiple-layer nanoparticle coating (on microparticles) that is between about 5 nanometers to about 100 microns thick, for example.

The non-metallic microparticles may contain one or more materials selected from the group consisting of a glass, a ceramic, an organic structure, a composite, and a combination thereof.

The nanoparticles contain hydrogen and may contain one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof.

In some embodiments, the nanoparticles are attached to the microparticles with organic ligands, such as organic ligands selected from the group consisting of aldehydes, alkanes, alkenes, silicones, polyols, poly(acrylic acid), poly (quaternary ammonium salts), poly(alkyl amines), poly(alkyl carboxylic acids) including copolymers of maleic anhydride or itaconic acid, poly(ethylene imine), poly(propylene imine), poly(vinylimidazoline), poly(trialkylvinyl benzyl ammonium salt), poly(carboxymethylcellulose), poly(D- or L-lysine), poly(L-glutamic acid), poly(L-aspartic acid), poly (glutamic acid), heparin, dextran sulfate, 1-carrageenan, pentosan polysulfate, mannan sulfate, chondroitin sulfate, and combinations or derivatives thereof.

In other embodiments, the nanoparticles are attached to the microparticles without organic ligands. Also it is possible that a portion of the nanoparticles is attached to the microparticles with organic ligands and the remainder of the nanoparticles is attached to the microparticles without organic ligands.

The microparticles may include a plurality of hollow shapes selected from the group consisting of spheres, cubes, rods, octets, irregular shapes, random shapes, and combinations thereof. In some embodiments, the microparticles are hollow microspheres. Hollow microspheres are structures that encompass a small closed volume. Typically a thin shell contains a small amount of gas (e.g., air, an inert gas, or a synthetic mixture of gases) that may be at a pressure below one atmosphere. Since air and other gases are excellent thermal insulators and have very low heat capacity compared to any solid material, hollow microspheres can provide low thermal conductivity and low heat capacity. The hollow microspheres may also contain empty space, i.e. vacuum or near vacuum.

The hollow shapes may have an average maximum dimension of less than 0.2 mm and an average ratio of maximum dimension to wall thickness greater than 5. For example, the hollow shapes may have an average maximum dimension of about, or less than about, 100 μm, 50 μm, 20 μm, or 10 μm. Also, the hollow shapes may have an average ratio of maximum dimension to wall thickness of about, or greater than about, 10, 15, 20, or 25. The wall thickness need not be uniform, either within a given shape or across all shapes. Hollow shapes, compared to perfect spheres, may contain more or less open space between shapes, depending on packing configuration.

The pores between hollow shapes may also be characterized by an average diameter, which is an effective diameter to account for varying shapes of those regions. The average diameter of spaces between hollow shapes may be also less than 0.2 mm, such as about, or less than about, 100 μm, 50 μm, 20 μm, 10 μm, or 5 μm. When there is an adhesive or matrix material present, some or all of the space between hollow shapes will be filled and therefore not porous (except for porosity, if any, within the adhesive or matrix material). In some embodiments, the total porosity is about, or at least about, 60%, 70%, 80%, 85%, 90%, 95%, 99%, or 100% closed porosity, not including the space between hollow shapes. In some embodiments, the total porosity is about, or at least about, 50%, 60%, 70%, 80%, 85%, 90%, 95%, 99%, or 100% closed porosity, including the space between hollow shapes. Essentially, the porosity resulting from open space between hollow shapes may be closed, independently from the closed porosity within the hollow shapes.

The spheres (or other shapes), in other embodiments, are not hollow or only partially hollow, i.e. porous. The spheres (or other shapes) may be bonded together with an adhesive and/or embedded in a matrix material. In certain embodiments, the spheres (or other shapes) are sintered together without an adhesive or matrix material. It is possible to combine these techniques so that a portion of shapes are bonded together with an adhesive or matrix material while another portion of shapes are sintered together without an adhesive or matrix material.

In various embodiments, the microparticles are spherical or sphere-like, spheroidal, ellipsoidal, or rod or rod-like microstructures. When hollow, the microparticles may contain empty space or may contain air or another gas, such as argon, nitrogen, helium, carbon dioxide, etc.

The microparticles may include a polymer, ceramic, or metal, for example. In some embodiments, the microparticles contain a glass, $SiO_2$, $Al_2O_3$, $AlPO_4$, or a combination thereof. In some embodiments, the microparticles contain polyethylene, poly(methyl methacrylate), polystyrene, polyvinylidene chloride, poly(acrylonitrile-co-vinylidene chloride-co-methyl methacrylate), or a combination thereof. The microparticles may include carbon, a thermally treated organic material, or a carbonized organic.

Possible microparticles also include hollow glass spheres, hollow aluminum phosphate spheres, hollow alumina spheres, hollow zirconia spheres, other ceramic hollow spheres, hollow polyethylene spheres, hollow polystyrene spheres, hollow polyacrylate spheres, hollow polymethacrylate spheres, or hollow thermoplastic microspheres containing polymers such as vinylidene chloride, acrylo-nitrile or methyl methacrylate. While spherical shapes may be preferred, other geometries in the aforementioned materials may also be utilized.

Closed-cell microparticles (employed in some embodiments) have closed porosity. By "closed porosity" it is meant that the majority of the porosity present in the microstructure results from closed pores that do not permit fluid flow into or through the pores. By contrast, "open porosity" results from open pores that permit fluid flow into and out of the pores. The total porosity of the microstructure is the sum of open porosity (measurable by intrusion methods, e.g. mercury intrusion) and closed porosity (measurable by microscopic image analysis or calculable from Archimedes measurements, when the bulk density is measured and the theoretical density is known).

The microstructure may be porous with at least 60% void volume fraction, which is the total porosity. In some embodiments, the void volume fraction of the microstructure is at least 65%, 70%, 75%, 80%, 85%, or 90% (total porosity). The porosity may derive from space both within particles (e.g., hollow shapes as described herein) as well as space outside and between particles. The total porosity accounts for both sources of porosity.

In some embodiments, the total porosity is about, or at least about, 50%, 60%, 70%, 80%, 85%, 90%, 95%, 99%, or 100% closed porosity. In certain preferred embodiments, essentially all of the porosity is closed porosity.

In some embodiments, closed porosity is attained with closed cells within the microstructure. For example, the microstructure may include closed-cell foam with an average pore size of less than 0.2 mm, such as an average pore size of about, or less than about, 100 μm, 50 μm, 20 μm, or 10 μm.

In some embodiments, closed porosity is attained with face-sheets disposed on the microstructure. A "face-sheet" refers to any suitable barrier disposed on one or more surfaces of the microstructure to close at least a portion of the pores. The face-sheet may be fabricated from the same material as the rest of the microstructure, or from a different material. The thickness of the face-sheet may vary, such as an average thickness of about 10 μm, 50 μm, 100 μm, 0.5 mm, 1 mm, or more. The face-sheet may be joined to the microstructure using sintering, adhesion, or other chemical or physical bonding, or mechanical means, for example. The face-sheets may be disposed on the top or bottom of the microstructure, or both top and bottom, to attain closed porosity.

The microstructure may include an open-celled micro-foam or micro-truss structure with an average cell size less than 0.2 mm, such as an average cell size of about, or less than about, 500 μm, 200 μm, 100 μm, or 50 μm.

In some embodiments, the microstructure comprises a plurality of hollow spheres having an average sphere diameter of less than 0.2 mm, such as an average sphere diameter of about, or less than about, 100 μm, 50 μm, 20 μm, or 10 μm. It is noted that "sphere" means substantially round geometrical objects in three-dimensional space that resemble the shape of a round ball. Not every "sphere" is perfectly round, some spheres may be fragmented, and other shapes may be present within the spheres. For example, imperfect spheres may arise due to pressure applied during sintering, leading to ovoids (egg shapes) or other irregular shapes or random shapes.

By "hollow spheres" it is meant that there is at least some empty space (or space filled with air or another gas such as an inert gas) in the spheres. Typically, the hollow spheres have an average sphere diameter to wall thickness ratio greater than 5, such as about 10, 15, 20, 25, or higher. The average sphere diameter is the total diameter, inclusive of material and space in the sphere. The wall thickness need not be uniform, either within a given sphere or across all spheres.

Generally speaking, the microparticles may include a plurality of hollow shapes selected from the group consisting of spheres, cubes, rods, octets, irregular shapes, random shapes, and combinations thereof. By "hollow shapes" it is meant that there is at least some empty space (or space filled with air or another gas such as an inert gas) in the shapes. The hollow shapes may have an average maximum dimension of less than 0.2 mm and an average ratio of maximum dimension to wall thickness greater than 5. For example, the hollow shapes may have an average maximum dimension of about, or less than about, 100 μm, 50 μm, 20 μm, or 10 μm. Also, the hollow shapes may have an average ratio of maximum dimension to wall thickness of about, or greater than about, 10, 15, 20, or 25. The wall thickness need not be uniform, either within a given shape or across all shapes. Hollow shapes, compared to perfect spheres, may contain more or less open space between shapes, depending on packing configuration.

The pores between hollow shapes may also be characterized by an average diameter, which is an effective diameter to account for varying shapes of those regions. The average diameter of spaces between hollow shapes may be also less than 0.2 mm, such as about, or less than about, 100 μm, 50 μm, 20 μm, 10 μm, or 5 μm. When there is an adhesive or matrix material present, some or all of the space between hollow shapes will be filled and therefore not porous (except for porosity, if any, within the adhesive or matrix material). In some embodiments, the total porosity is about, or at least about, 60%, 70%, 80%, 85%, 90%, 95%, 99%, or 100% closed porosity, not including the space between hollow shapes. In some embodiments, the total porosity is about, or at least about, 50%, 60%, 70%, 80%, 85%, 90%, 95%, 99%, or 100% closed porosity, including the space between hollow shapes. Essentially, the porosity resulting from open space between hollow shapes may be closed, independently from the closed porosity within the hollow shapes.

The hollow spheres (or other shapes) may be bonded together with an adhesive and/or embedded in a matrix material. In certain embodiments, the hollow spheres (or other shapes) are fused together without an adhesive or matrix material. It is possible to combine these techniques so that a portion of hollow shapes are bonded together with an adhesive or matrix material while another portion of hollow shapes are fused together without an adhesive or matrix material.

In some embodiments, the microparticles include hierarchical porosity comprising macropores having an average macropore diameter of 10 μm or greater and micropores having an average micropore diameter of less than 10 μm. For example, the average macropore diameter may be about, or greater than about, 20 μm, 30 μm, 50 μm, 75 μm, 100 μm, 200 μm, 300 μm, 400 μm, or 500 μm. The average micropore diameter may be about, or less than about, 8 μm, 5 μm, 2 μm, 1 μm, 0.5 μm, 0.2 μm, or 0.1 μm. In certain embodiments, the average macropore diameter is 100 μm or greater and the average micropore diameter is 1 μm or less.

Structural integrity is important for the microstructure for some commercial applications. The structural integrity can be measured by the crush strength, which is the greatest compressive stress that the microstructure can sustain without fracture. The crush strength associated with the microstructure of some embodiments is at least about 0.5, 1, 2, 3, 4, 5, 6, 7, 8, 9, or 10 MPa (1 Pa=1 $N/m^2$) at 25° C. or higher temperatures.

In some embodiments, a method for depositing metal hydride nanoparticles on a metallic micropowder comprises a first step of suspending metal hydride nanoparticles in an anhydrous solvent. Microparticles are added to the suspension of nanoparticles. The metal hydride nanoparticles are assembled on the microparticles, and the solvent is removed. In these or other embodiments, the microparticles are present in an anhydrous solvent and then the metal hydride nanoparticles are added to the mixture. Methods for depositing metal hydride nanoparticles on a non-metallic micropowder are similar.

Some variations provide a microparticle with multiple layers and one outer layer containing or consisting of nanoparticles. The outer shell may be made continuous (e.g., fused together, as defined below) rather than being formed from discrete nanoparticles, thereby improving durability and structural rigidity.

The nanoparticles may be dispersed in a matrix. Layers of nanoparticles may be separated by an organic or oxide material. The coating on the microparticles may also include nanoparticles fused together to form a solid layer on the surface.

In some embodiments of the invention, the nanoparticles are fused together to form a continuous coating. As intended in this specification, "fused" should be interpreted broadly to mean any manner in which nanoparticles are bonded, joined, coalesced, or otherwise combined, at least in part, together. Many known techniques may be employed for fusing together nanoparticles.

In various embodiments, fusing is accomplished by sintering, heat treatment, pressure treatment, combined heat/pressure treatment, electrical treatment, electromagnetic treatment, melting/solidifying, contact (cold) welding, solution combustion synthesis, self-propagating high-temperature synthesis, solid state metathesis, or a combination thereof.

In certain embodiments, fusing is accomplished by sintering of nanoparticles. "Sintering" should be broadly construed to mean a method of forming a solid mass of material by heat and/or pressure without melting the entire mass to the point of liquefaction. The atoms in the materials diffuse across the boundaries of the particles, fusing the particles together and creating one solid piece. The sintering temperature is typically less than the melting point of the material. In some embodiments, liquid-state sintering is used, in which at least one but not all elements are in a liquid state.

When sintering or other heat treatment is utilized, the heat or energy may be provided by electrical current, electromagnetic energy, chemical reactions (including formation of ionic or covalent bonds), electrochemical reactions, pressure, or combinations thereof. Heat may be provided for initiating chemical reactions (e.g., to overcome activation energy), for enhancing reaction kinetics, for shifting reaction equilibrium states, or for adjusting reaction network distribution states.

In some embodiments, a sintering technique (for fusing together nanoparticles) may be selected from the group consisting of radiant heating, induction, spark plasma sintering, microwave heating, capacitor discharge sintering, and combinations thereof.

In some variations, metal hydride-coated metal microparticles are used in standard powder metallurgy processes to create a solid or foam metal structure. This has the advantage of providing microparticles with sintering aids in direct contact with the microparticles in an even distribution throughout the powder pack. These hydrides act as sintering aids by decomposing at elevated temperatures, leaving reactive metal nanoparticles on the surface of the metal microparticles and thus inducing favorable sintering reactions. Some of these favorable sintering reactions may include, but are not limited to, oxide displacement and eutectic formation for liquid-phase sintering. Metal hydrides and metal alloy hydrides typically have relatively low melting points, i.e. lower than the corresponding (non-hydride) metals or metal alloys.

In addition to this, the decomposition of the hydrides provides a protective reducing atmosphere throughout the heated powder to prevent oxidation during sintering. The metal hydride nanoparticles can also act as strengthening agents. Possible methods for strengthening the sintered material include, but are not limited to, formation of particulate inclusions, solid solution alloying, grain refining agents, and precipitation strengthening.

If nano-metal hydrides are used in excess, they can act both as a way to form a reducing atmosphere and act as a blowing agent for the production of metallic foams. The even distribution of hydrides throughout the powder pack may help establish a good cell distribution in the resulting foam.

Some possible powder metallurgy processing techniques that may be used include, but are not limited to, hot pressing, sintering, high-pressure low-temperature sintering, extrusion, metal injection molding, and additive manufacturing.

A sintering technique may be selected from the group consisting of radiant heating, induction, spark plasma sintering, microwave heating, capacitor discharge sintering, and combinations thereof. Sintering may be conducted in the presence of a gas, such as air or an insert gas (e.g., Ar, He, or $CO_2$), or in a reducing atmosphere (e.g., $H_2$ or CO). Sintering $H_2$ may be provided by decomposition of the hydride coating.

Various sintering temperatures or ranges of temperatures may be employed. A sintering temperature may be about, or less than about, 100° C., 200° C., 300° C., 400° C., 500° C., 600° C., 700° C., 800° C., 900° C., or 1000° C.

In some embodiments employing (single) metal microparticles, a sintering temperature is preferably less than the metal melting temperature. In some embodiments employing metal alloy microparticles, a sintering temperature may be less than the maximum alloy melting temperature, and further may be less than the minimum alloy melting temperature. In certain embodiments, the sintering temperature may be within the range of melting points for the selected alloy. In some embodiments, a sintering temperature may be less than a eutectic melting temperature of the microparticle alloy.

At a peritectic decomposition temperature, rather than melting, a metal alloy decomposes into another solid compound and a liquid. In some embodiments, a sintering temperature may be less than a peritectic decomposition temperature of the microparticle metal alloy.

If there are multiple eutectic melting or peritectic decomposition temperatures, a sintering temperature may be less all of these critical temperatures, in some embodiments.

In some embodiments pertaining to aluminum alloys employed in the microparticles, the sintering temperature is preferably selected to be less than about 450° C., 460° C., 470° C., 480° C., 490° C., or 500° C. The decomposition temperature of peritectic aluminum alloys is typically in the range of 400-600° C. (Belov et al., *Multicomponent Phase Diagrams: Applications for Commercial Aluminum Alloys*, Elsevier, 2005), which is hereby incorporated by reference herein. Melting temperatures, eutectic melting temperatures, and peritectic decomposition temperatures for various alloys can be found in MatWeb (www.matweb.com), a searchable online database of engineering materials with over 100,000 data sheets, which is hereby incorporated by reference herein.

In conventional powder metallurgy processes, the resulting structures derived from these hydride-coated particles would be unique. The surrounding nanoparticles may be observed as inclusions and/or act to restrict grain growth beyond the original volume of the coated microparticle. While grain growth may be limited to the inclusion boundaries, it would be possible to have grains within the inclusion boundary. This could arise for many reasons, such as if the micropowder used is already polycrystalline and/or the material is work-hardened. These inclusions could range from about 10 nm to 1 micron, for example, and be composed of an oxide, metal, and/or metal alloy.

Figure 3:
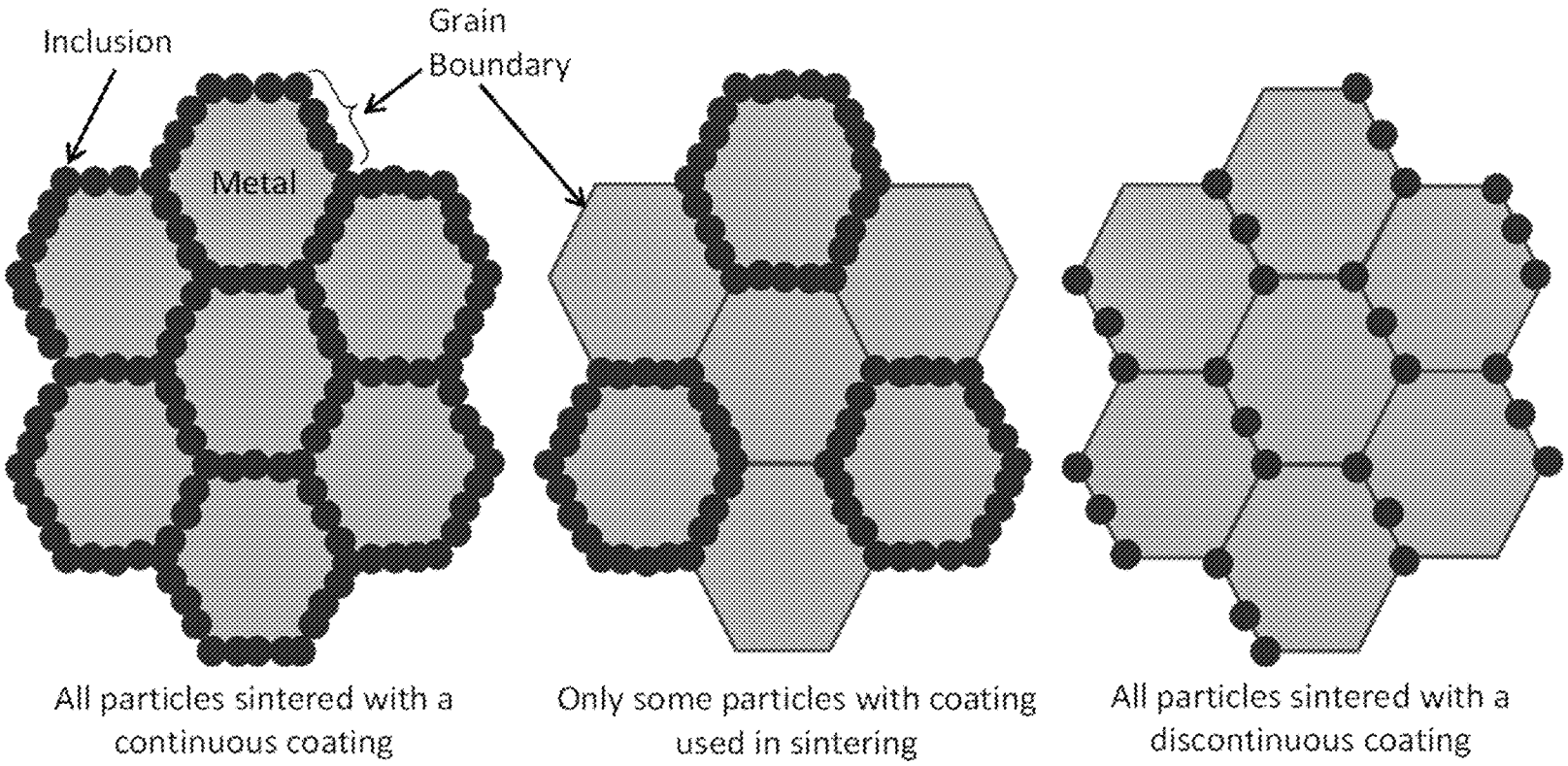
FIG. 3 is a graphical representation of some exemplary microstructures from sintered hydride-coated metal micropowders.

Multiple potential structures exist, depending on the degree of microparticle coverage and the number of covered microparticles used in sintering. A characteristic feature of this material in some embodiments is continuous to periodic two- and three-dimensional structures of inclusions at or near a grain boundary. A graphical representation of some, but not all possible, microstructures from sintered hydride-coated metal micropowders is shown in FIG. 3.

Optionally, the material could be fully normalized to dissolve the desired inclusions. Normalization is the process of fully solutionizing the metal. This would mask the original sintered structures. The expected grain growth of the material during this process would drastically reduce the material's overall strength and require substantial post working.

In additive manufacturing (laser melting and electron beam melting), the proposed structures are still expected to form. However, due to the melt pool formation, the structures may lack some of the aforementioned characteristic features. For example, random nucleation may be present. Not wishing to be bound by theory, the nanoparticles may act as either insoluble inclusions or composition gradients in the melt pool during processing. Due to the fast rate of cooling in additive manufacturing, this will induce nucleation at these points, creating a unique structure. This may promote equiaxed grain growth and decrease the tendency towards columnar and preferential grain growth currently observed in additive manufacturing.

Some variations provide a solid article comprising at least 0.25 wt % of a material containing a plurality of metal-containing or metal alloy-containing microparticles that are at least partially coated with a plurality of metal hydride or metal alloy hydride nanoparticles, wherein the nanoparticles form continuous or periodic inclusions at or near grain boundaries between the microparticles.

The microparticles may be characterized by an average microparticle size between about 1 micron to about 1 millimeter. The nanoparticles may be characterized by an average nanoparticle size less than 1 micron.

The solid article may contain at least about 1 wt %, 5 wt %, 10 wt %, 20 wt %, 30 wt %, 40 wt %, 50 wt %, 60 wt %, 70 wt %, 80 wt %, 90 wt %, 95 wt %, or more, of the material.

In some solid articles, the plurality of nanoparticles forms a nanoparticle coating (in one or multiple layers) that is between about 5 nanometers to about 100 microns thick.

In some embodiments, the microparticles contain one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof.

In some embodiments, the nanoparticles contain hydrogen and one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof.

In these solid articles, the nanoparticles may be attached to the microparticles with organic ligands such as organic ligands selected from the group consisting of aldehydes, alkanes, alkenes, silicones, polyols, poly(acrylic acid), poly (quaternary ammonium salts), poly(alkyl amines), poly(alkyl carboxylic acids) including copolymers of maleic anhydride or itaconic acid, poly(ethylene imine), poly(propylene imine), poly(vinylimidazoline), poly(trialkylvinyl benzyl ammonium salt), poly(carboxymethylcellulose), poly(D- or L-lysine), poly(L-glutamic acid), poly(L-aspartic acid), poly (glutamic acid), heparin, dextran sulfate, 1-carrageenan, pentosan polysulfate, mannan sulfate, chondroitin sulfate, and combinations or derivatives thereof.

The solid article may be produced by a process selected from the group consisting of hot pressing, cold pressing and sintering, extrusion, injection molding, additive manufacturing, electron beam melting, selected laser sintering, pressureless sintering, and combinations thereof.

In some embodiments, the article is a sintered structure with a porosity between 0% and about 75%.

The solid article may be, for example, a coating, a coating precursor, a substrate, a billet, a net shape part, a near net shape part, or another object.

EXAMPLES

Example 1: $ZrH_2$ Nanoparticles Assembled on the Surface of A17075 Alloy Micropowder 0.1 g of a 3.7:1 weight ratio of LiCl:$ZrH_2$ nanoparticles is added to a vial with 10 mL THF and stirred with a magnetic stir bar. 0.1 g aluminum alloy 7075 micropowder (−325 mesh) is added to the mixing suspension. The suspension is stirred for 10 min. The suspension is allowed to settle out and the THF is decanted off the top. 10 mL THF is added to the particulate in the vial and stirred for 10 min. Twice more, the suspension is allowed to settle out and the THF is decanted off the top, followed by 10 mL THF added to the particulate in the vial and stirred for 10 min. This is done to remove dissolved LiCl. The remaining THF is decanted then allowed to dry in the glove box. All work is completed inside a glove box with oxygen and moisture below 5 ppm.

Figure 4:
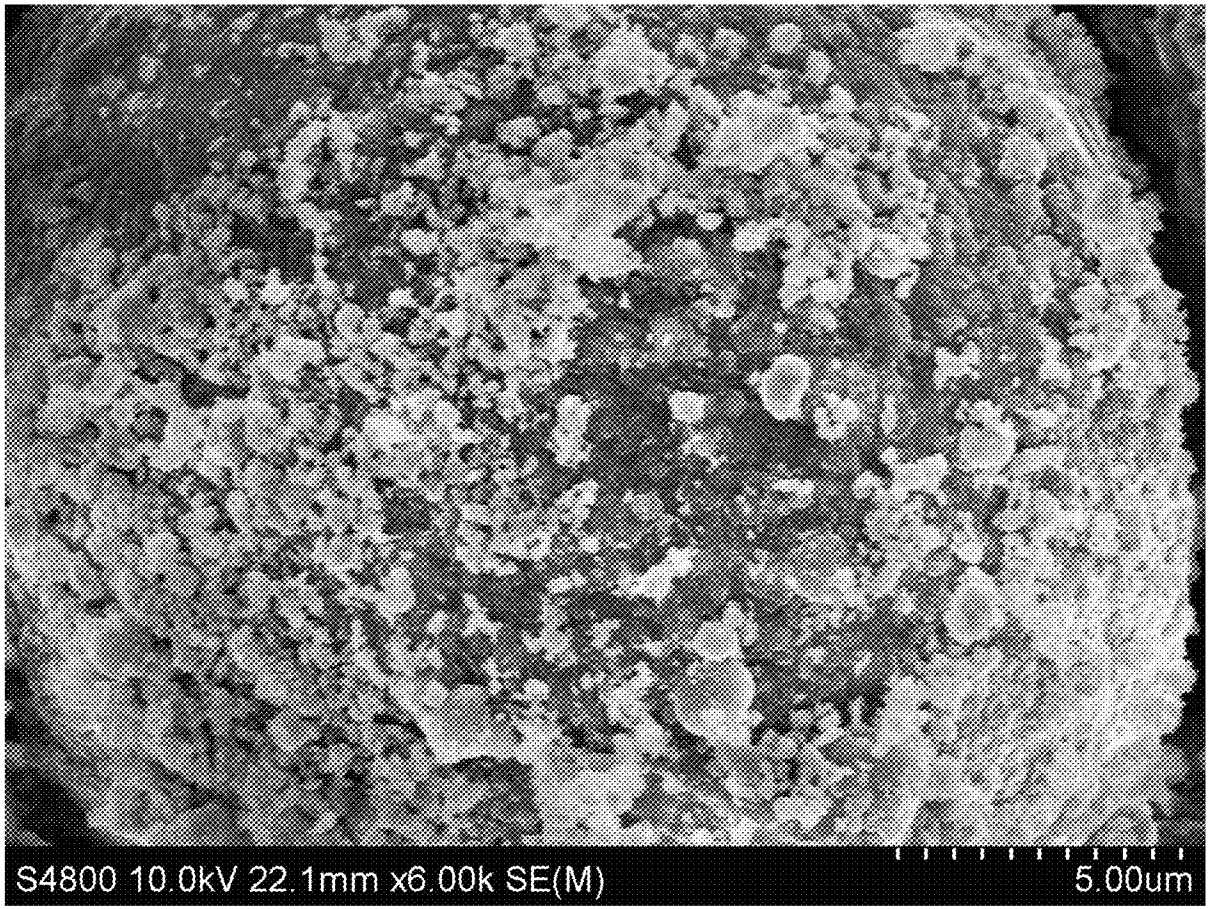
FIG. 4 is an SEM image showing $ZrH_2$ nanoparticles assembled on the surface of A17075 micropowder as a discontinuous coating (Example 1).
Figure 5:
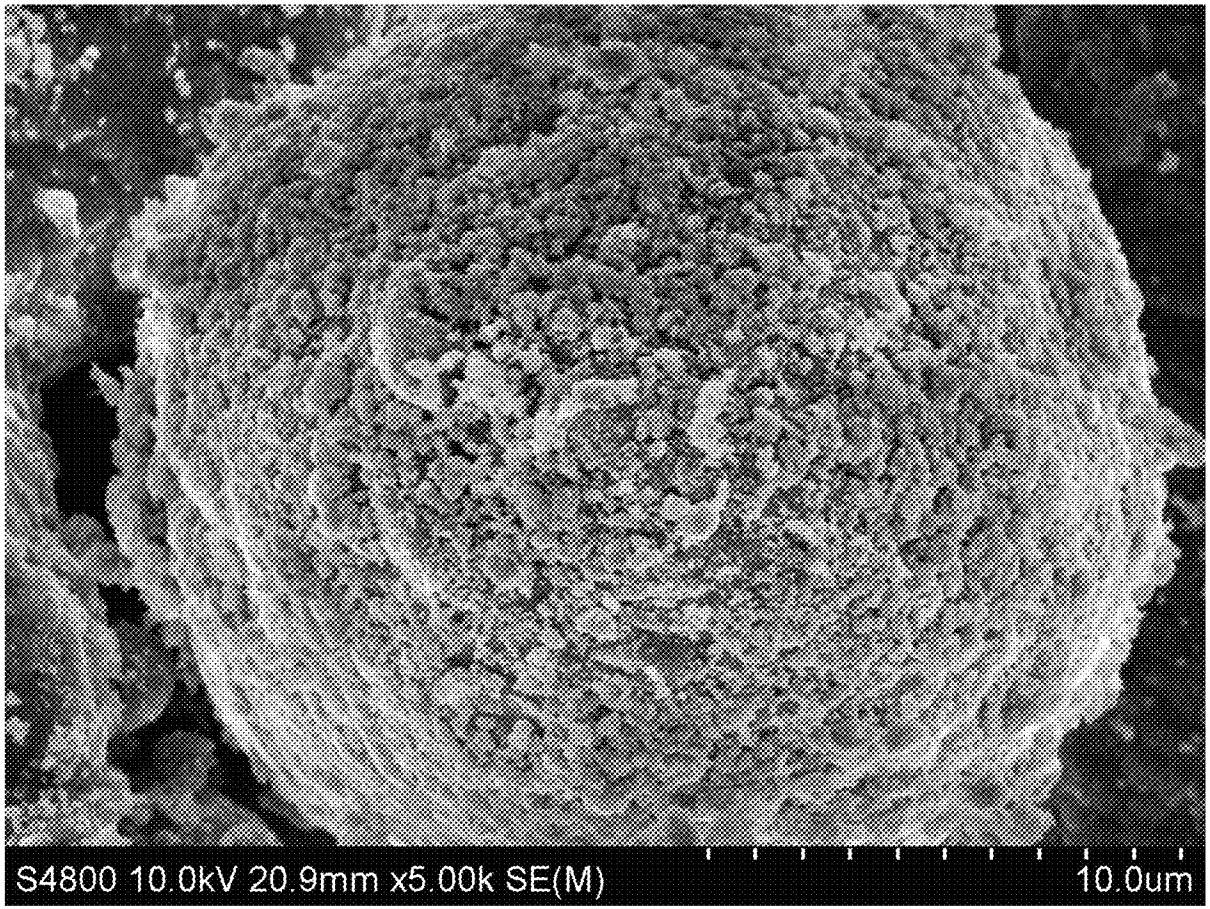
FIG. 5 is an SEM image showing $ZrH_2$ nanoparticles assembled on the surface of A17075 micropowder as a continuous coating (Example 1).

Samples are taken to analyze in the SEM and confirm assembly of nanoparticles on the surface of the aluminum powder. FIG. 4 shows $ZrH_2$ nanoparticles assembled on the surface of A17075 micropowder as a discontinuous coating. FIG. 5 shows $ZrH_2$ nanoparticles assembled on the surface of A17075 micropowder as a continuous coating.

Figure 6:
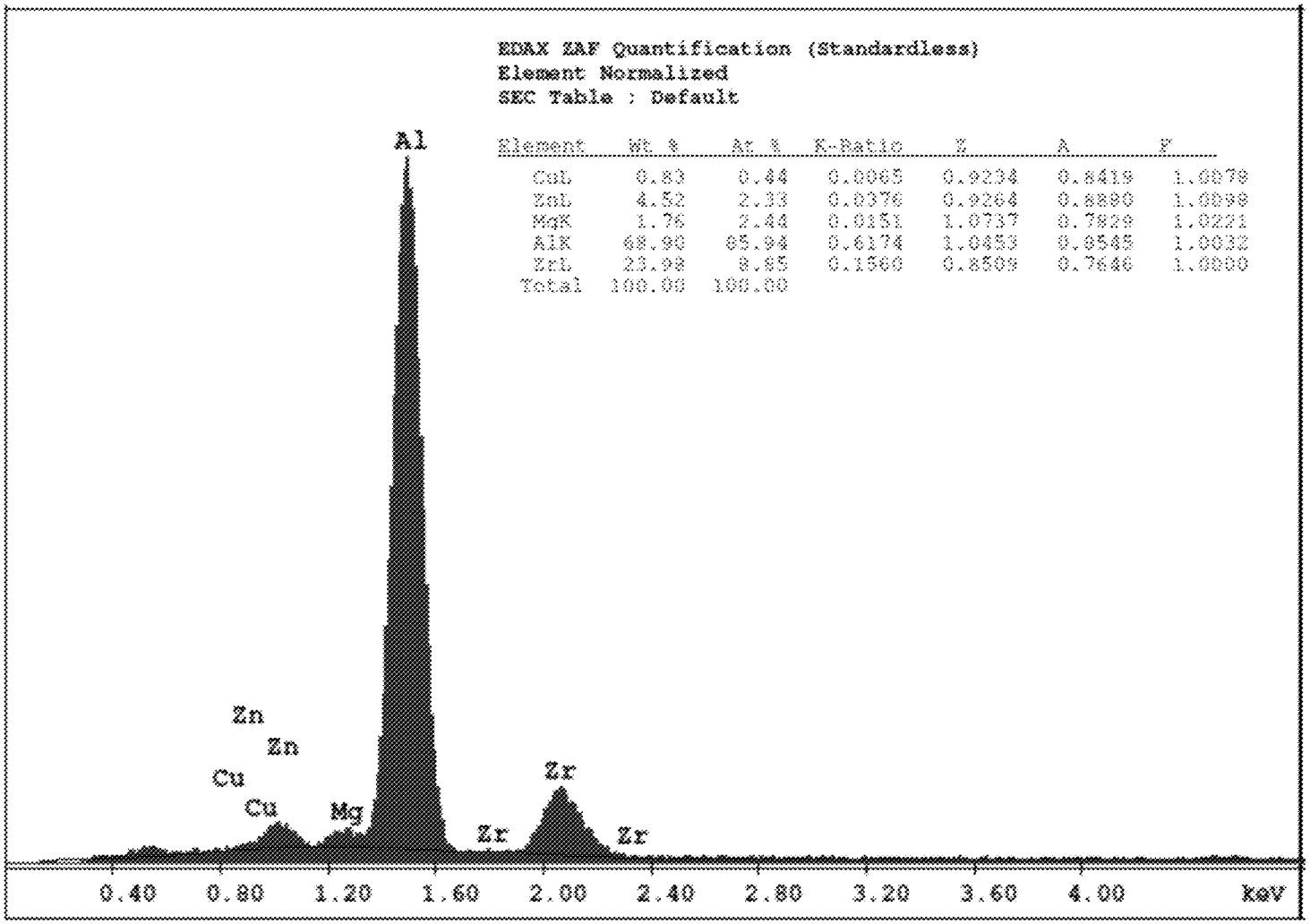
FIG. 6 is an EDS scan confirming $ZrH_2$ on surface of A17075 particle with no detectable chlorine from LiCl (Example 1).

EDS is used to confirm that particulate on the surface is zirconium hydride and contains no LiCl. FIG. 6 gives EDS confirmation of $ZrH_2$ on surface of A17075 particle with no detectable chlorine from LiCl. Hydrogen and Lithium are not detectable with EDS and the presence of zirconium hydride and LiCl is assumed based on the presence of chlorine and zirconium. All observed particles from Example 1 are coated with ZrH2. A lack of significant detectable oxygen is also important to confirm that the zirconium hydride nanoparticles have not oxidized despite air exposure during specimen preparation.

Example 2: Sintering of A17075 Alloy Micropowder Coated with $ZrH_2$ Nanoparticles Nano-metal hydrides can be used as sintering aids to produce a metal structure. This is demonstrated here using zirconium hydride with an aluminum alloy powder. Aluminum alloy powders are notoriously difficult to sinter using many conventional processes due to the tough oxide shell. When heated above about 350° C., a zirconium hydride-coated aluminum alloy powder will begin an oxide displacement reaction and release hydrogen gas through the following reaction:

$$3ZrH_2+2Al_2O_3=3H_2+3ZrO_2+4Al$$

Figure 7:
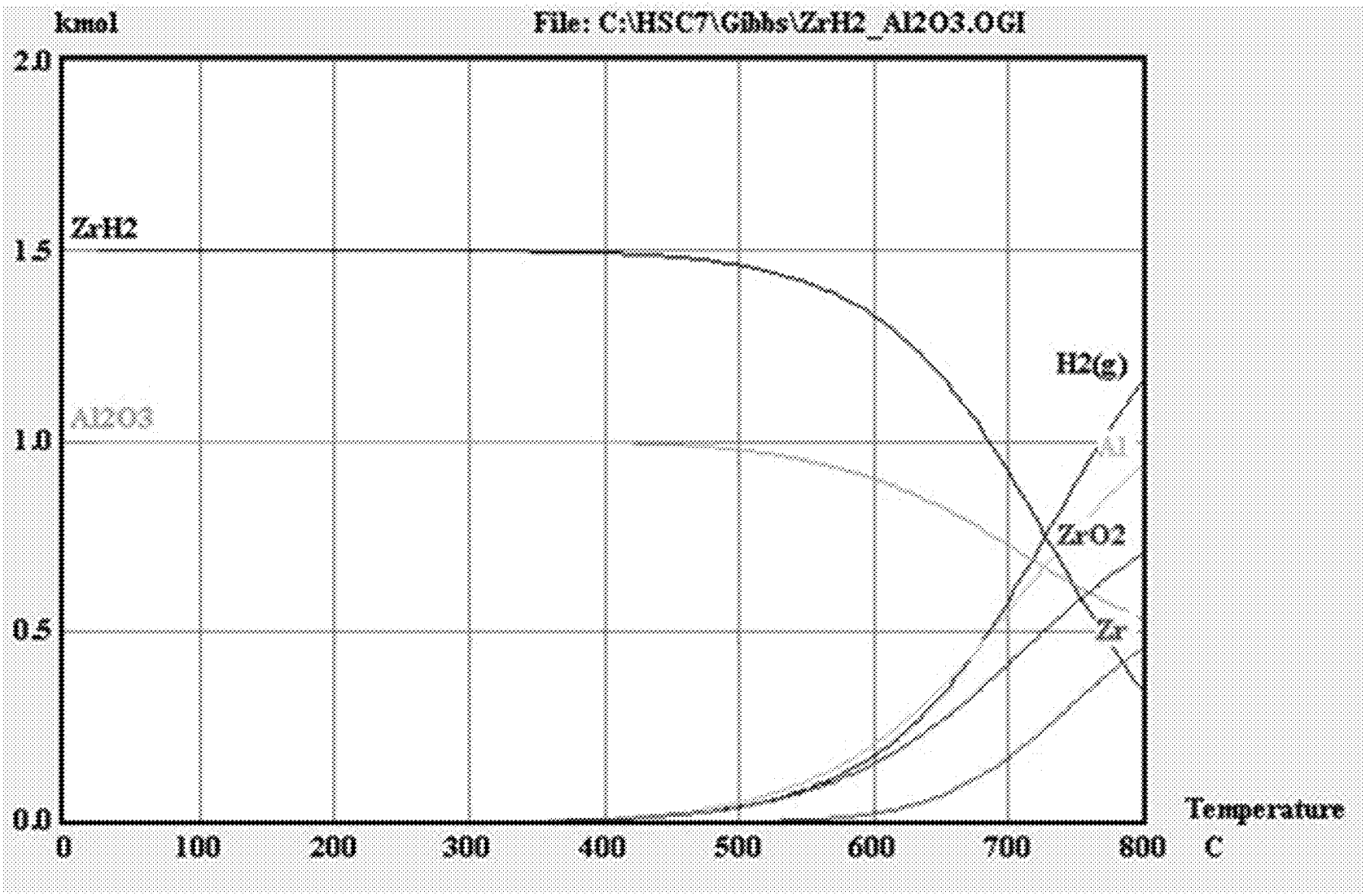
FIG. 7 is a plot of equilibrium concentrations versus temperature for $ZrH_2$ and $Al_2O_3$ (Example 2).

The zirconium oxide formation displaces the aluminum oxide barrier layer, allowing the aluminum metal alloy to sinter without impedance from the oxide layer. Zirconium hydride is beneficial because of the thermodynamic favorability of this reaction. The equilibrium concentrations versus temperature for $ZrH_2$ and $Al_2O_3$ have been calculated (HSC Chemistry 7.0, Houston, Tex., US) and graphically represented in FIG. 7.

Residual non-oxidized zirconium can then react with the bulk aluminum alloy to form $Al_3Zr$ dispersoids, which can strengthen the alloy and prevent grain growth. This reaction should be completed in an inert or vacuum environment. The reaction can be controlled by the partial pressure of hydrogen which drives the equilibrium state. For instance, lower pressures result in a lower partial pressure of hydrogen in the reaction area which drives the reaction forward. Likewise, a flowing inert gas such as argon may also drive the reaction by constantly carrying the hydrogen away from the reaction site.

This reaction and effect is confirmed by sintering loose powder from Example 1 in an aluminum DSC pan at 480° C. for 2 hours under flowing UHP argon. 480° C. was chosen as the target sintering temperature of the material because it is the solid solution temperature of aluminum 7075 alloy. After cooling, the material is analyzed using the SEM.

Figure 8:
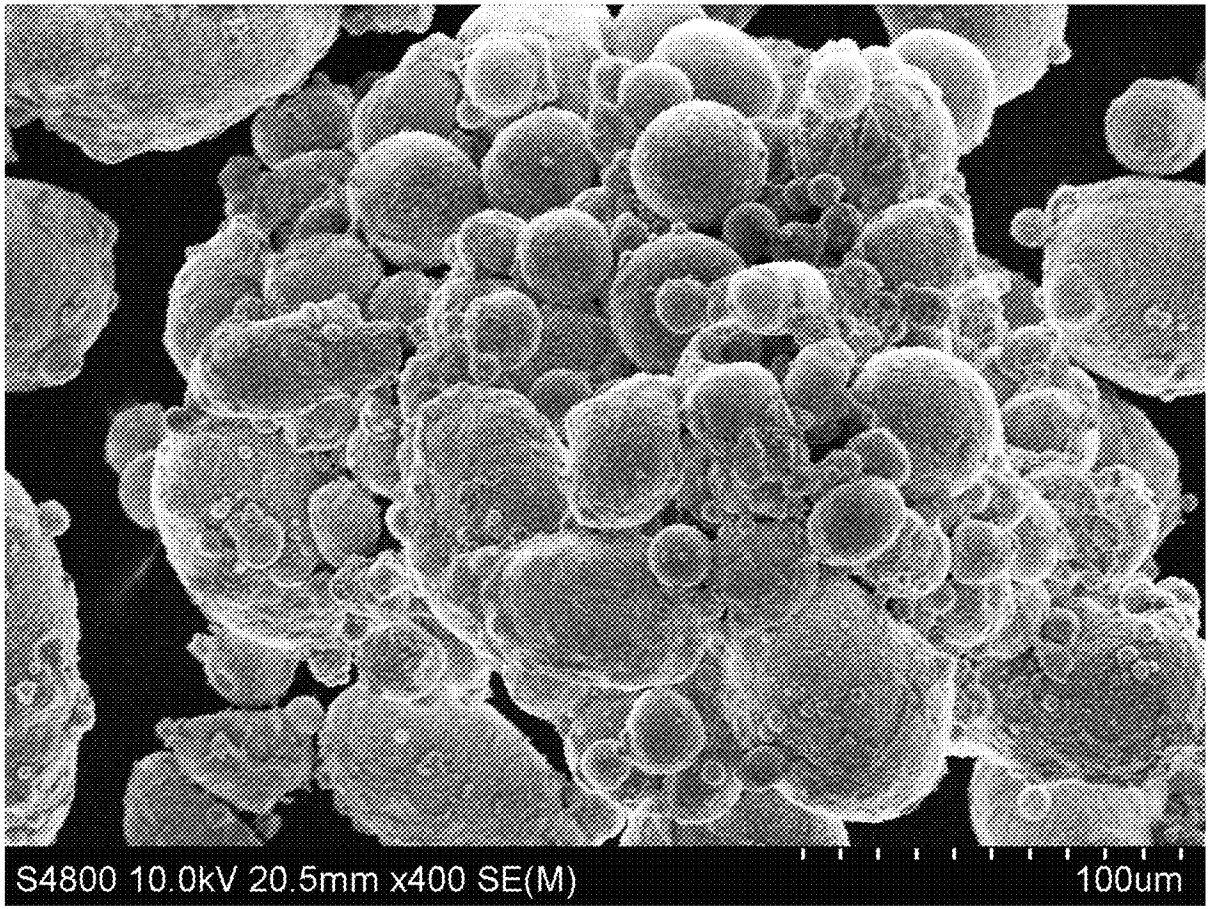
FIG. 8 is an SEM image showing sintered A17075 coated with $ZrH_2$ nanoparticles at 480° C. (Example 2).

FIG. 8 shows sintered A17075 coated with $ZrH_2$ nanoparticles at 480° C. With the addition of a zirconium hydride nanoparticle coating, the material is able to sinter at the 480° C. The particles showed signs of densification and necking. For comparison, an additional example without a zirconium nanoparticle coating is provided in Example 3.

Example 3: Sintering of A17075 Alloy Micropowder, Uncoated

Uncoated aluminum 7075 powder is placed as a loose powder in a graphite DSC pan and sintered at 700° C. for 2 hours under flowing UHP argon. (Note: the liquidus temperature for A17075 is 635° C.). After cooling, the material is analyzed using the SEM.

Figure 9:
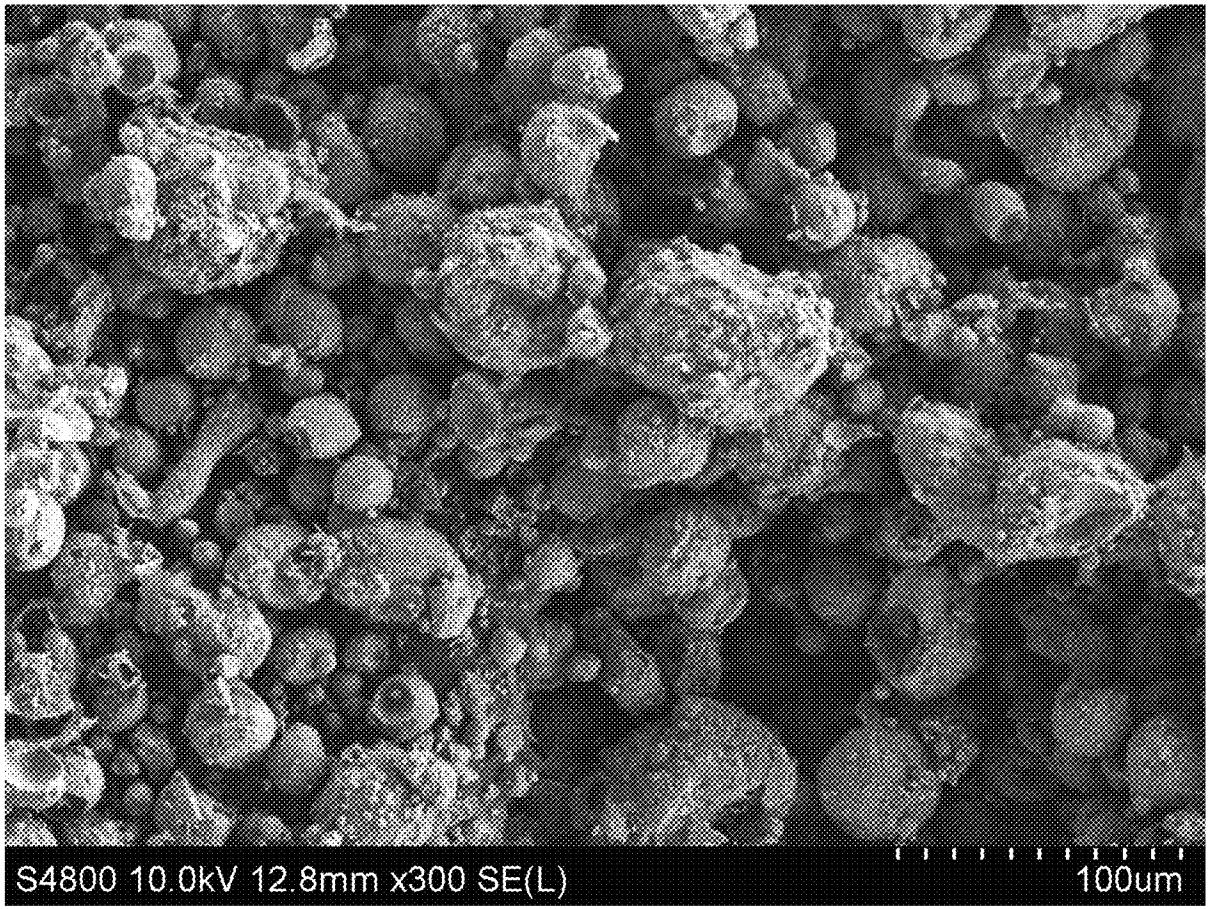
FIG. 9 is an SEM image showing A17075 powder sintered after 700° C. for 2 hours (Example 3).

FIG. 9 shows an SEM image of A17075 powder after 700° C. for 2 hours. The resulting material is still a free-flowing powder with only periodic necking between particles. Despite heating the material for an extended period of time well above the melting point, sintering is still inhibited by the oxide barrier.

New methods of manufacturing such as additive manufacturing are expected to benefit from the disclosed metal hydride-coated microparticles. The ability to displace surface oxides can play an important role in the formation of a melt pool during laser or electron beam additive manufacturing. This would allow the energy input on the powder bed to be decreased.

Also the hydrogen released during heating can reduce the requirements for purge gases in metal additive manufacturing.

An additional benefit for additive manufacturing is related to the reflectivity of the particles. Aluminum microparticles are highly reflective, which makes it difficult to locally melt using incident laser energy. Metal hydride particles have been shown to have varying optical properties which could be used to alter the surface absorptivity of the incident laser energy. This could be tailored to control energy absorptivity of a particle bed, thereby improving consistency in the system.

All of these factors have the potential to lower the operating costs of additive manufacturing and widening the parameter window to develop new processing techniques and materials.

This invention enables the sintering of high-strength aluminum parts. This enables net and near-net shape part production of high-strength aluminum components, especially with emerging additive manufacturing techniques such as electron beam melting or selective laser sintering. Other commercial applications also exist, including sintering aids in other base alloy powder metallurgy; foaming agent to produce metal foams; high surface area hydrogen storage materials; and battery or fuel cell electrodes.

In this detailed description, reference has been made to multiple embodiments and to the accompanying drawings in which are shown by way of illustration specific exemplary embodiments of the invention. These embodiments are described in sufficient detail to enable those skilled in the art to practice the invention, and it is to be understood that modifications to the various disclosed embodiments may be made by a skilled artisan.

Where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially.

All publications, patents, and patent applications cited in this specification are herein incorporated by reference in their entirety as if each publication, patent, or patent application were specifically and individually put forth herein.

The embodiments, variations, and figures described above should provide an indication of the utility and versatility of the present invention. Other embodiments that do not provide all of the features and advantages set forth herein may also be utilized, without departing from the spirit and scope of the present invention. Such modifications and variations are considered to be within the scope of the invention defined by the claims.

What is claimed is:

1. A material comprising a plurality of non-metallic microparticles that are partially coated with a plurality of nanoparticles containing a metal hydride or metal alloy hydride, wherein said microparticles are characterized by an average microparticle size from between 1 micron to about 1 millimeter, wherein said nanoparticles are characterized by an average nanoparticle size less than 1 micron, wherein said nanoparticles are attached to said microparticles without organic ligands, wherein said plurality of nanoparticles forms a nanoparticle coating that is between about 5 nanometers to about 100 microns thick, and wherein said nanoparticle coating has a surface area coverage on said microparticles from 0.25% to 95%.

2. The material of claim 1, wherein said material is in powder form.

3. The material of claim 1, wherein said average microparticle size is between about 10 microns to about 500 microns.

4. The material of claim 1, wherein said average nanoparticle size is between about 10 nanometers to about 500 nanometers.

5. The material of claim 1, wherein said plurality of nanoparticles forms a single-layer or multiple-layer nanoparticle coating.

6. The material of claim 1, wherein said non-metallic microparticles contain one or more materials selected from the group consisting of a glass, a ceramic, an organic structure, a composite, and a combination thereof.

7. The material of claim 1, wherein said nanoparticles contain hydrogen and one or more metals selected from the group consisting of Li, Be, Na, Mg, K, Ca, Sc, Y, Ti, Zr, Hf, V, Nb, Ta, Cr, Mo, W, Mn, Tc, Re, Fe, Ru, Os, Fe, Rh, Ir, Ni, Pd, Pt, Cu, Ag, Au, Zn, Cd, Al, Si, B, C, P, S, Ga, Ge, In, Sn, Sb, Pb, Bi, La, Ac, Ce, Th, Nd, U, and combinations or alloys thereof.

8. The material of claim 1, wherein said nanoparticles are attached to said microparticles via electrostatic attraction.

9. The material of claim 1, wherein said surface area coverage on said microparticles is from 1% to 95%.

10. The material of claim 1, wherein said surface area coverage on said microparticles is from 0.25% to 75%.

11. The material of claim 1, wherein said surface area coverage on said microparticles is from 10% to 75%.

* * * * *